US006916363B2

(12) United States Patent
Odajima

(10) Patent No.: US 6,916,363 B2
(45) Date of Patent: Jul. 12, 2005

(54) AIR FILTER

(75) Inventor: Sadao Odajima, Kadoma (JP)

(73) Assignee: Yamato Koubo Ltd., Osaka (JP)

( * ) Notice: Subject to any disclaimer, the term of this patent is extended or adjusted under 35 U.S.C. 154(b) by 153 days.

(21) Appl. No.: 10/452,632

(22) Filed: Jun. 3, 2003

(65) Prior Publication Data

US 2004/0003722 A1 Jan. 8, 2004

(30) Foreign Application Priority Data

Jul. 2, 2002 (JP) ..... 2002-193067

(51) Int. Cl.[7] ..... B03C 3/155

(52) U.S. Cl. ..... 96/66; 55/528; 55/DIG. 5; 55/DIG. 43; 55/DIG. 45; 264/DIG. 48

(58) Field of Search ..... 55/489, 527, 528, 55/DIG. 5, DIG. 39, DIG. 43, DIG. 44, DIG. 45; 96/17, 66, 69; 442/205, 320

(56) References Cited

U.S. PATENT DOCUMENTS 2,724,457 A * 11/1955 Besser ..... 96/17
2,782,933 A * 2/1957 Monsarrat ..... 210/460
2,929,464 A * 3/1960 Sprouse ..... 55/488
3,210,229 A * 10/1965 Feine ..... 156/213
3,977,847 A * 8/1976 Clark ..... 95/279
4,277,266 A * 7/1981 Dick ..... 55/381
5,037,455 A * 8/1991 Scheineson et al. ..... 96/17
5,230,226 A * 7/1993 Saarikettu ..... 66/202
5,472,467 A * 12/1995 Pfeffer ..... 55/488
5,492,551 A * 2/1996 Wolfe ..... 55/496
5,571,604 A * 11/1996 Sprang et al. ..... 428/212
5,589,245 A * 12/1996 Roell ..... 428/85
5,630,856 A * 5/1997 Pfeffer ..... 55/488
5,714,067 A * 2/1998 Sorrick ..... 210/490
6,036,739 A * 3/2000 New, Sr. ..... 55/527
6,110,249 A * 8/2000 Medcalf et al. ..... 55/514
6,165,244 A * 12/2000 Choi ..... 55/527
6,336,947 B1 * 1/2002 Atsumi et al. ..... 55/385.3
6,355,079 B1 * 3/2002 Sorvari et al. ..... 55/486
6,409,787 B1 * 6/2002 Smithies et al. ..... 55/514
6,428,610 B1 * 8/2002 Tsai et al. ..... 96/15
6,497,754 B2 * 12/2002 Joannou ..... 96/67

FOREIGN PATENT DOCUMENTS

JP 55-94612 * 7/1980 ..... 55/DIG. 44

* cited by examiner

*Primary Examiner*—Richard L. Chiesa
(74) *Attorney, Agent, or Firm*—Armstrong, Kratz, Quintos, Hanson & Brooks, LLP

(57) ABSTRACT

An air filter in which a thick sheet of textile of three-dimensionally knitted synthetic fiber thread is sliced at a middle position in a thickness direction and separated into a front face and a rear face. The front face or the rear face is one face side, and many short fibers are protruding from another face side. Further, the air filter is electrified as a whole.

1 Claim, 5 Drawing Sheets

AIR FILTER

BACKGROUND OF THE INVENTION

1. Field of the Invention

This invention relates to an air filter for air cleaning used for electric appliances for household and business use which need air current, and a manufacturing method for the same.

2. Description of the Related Art

A conventional air filter, as shown in FIG. 12, has a corrugated honeycomb construction in which a first member 26 of round wave and a flat second member 27 are layered in turn (piled up) to receive air current in a direction at right angles with the surface of the filter to collect dust and deodorize. And, as shown in FIG. 13, another conventional filter is composed of a pleated filter 28 convex portions and concave portions are formed in turn (in cross section) and a sheet filter 29 for keeping the configuration of the filter 28 to receive air current in a direction shown with arrows C.

However, the conventional air filters require much labor in production to corrugate, cut into a predetermined thickness, and pleat.

It is therefore an object of the present invention to provide an air filter having good collecting efficiency of dust and a manufacturing method for the same with which the air filter is easily made omitting the processes of corrugation, cutting into the predetermined thickness, and pleats.

BRIEF DESCRIPTION OF THE DRAWINGS

The present invention will be described with reference to the accompanying drawings in which.

PREFERRED EMBODIMENTS OF THE INVENTION

Preferred embodiments of the present invention will now be described with reference to the accompanying drawings.

Figure 1:
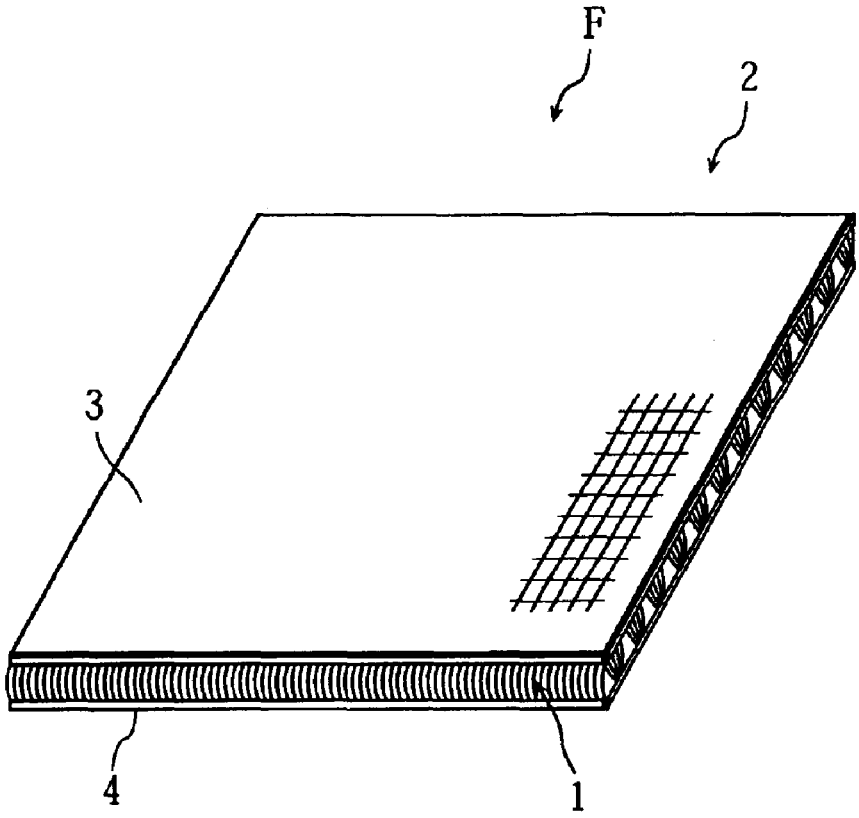
FIG. 1 is a perspective view showing a first embodiment of the present invention.
Figure 2:
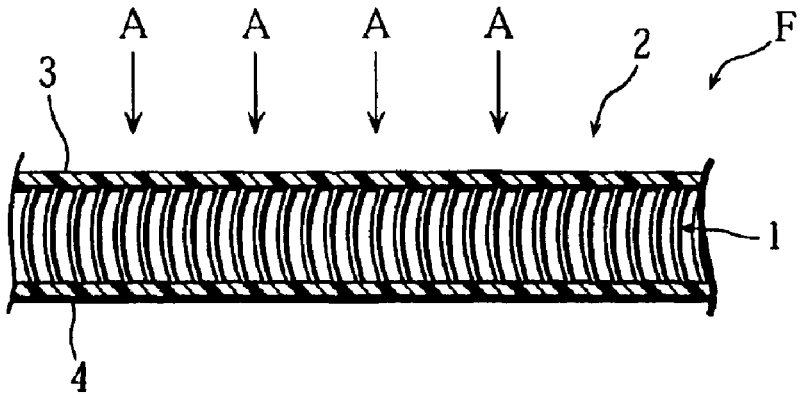
FIG. 2 is a cross-sectional side view.
Figure 3:
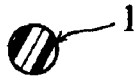
FIG. 3 is an enlarged cross-sectional view showing a monofilament.

FIGS. 1 through 3 show a first embodiment of the present invention. This air filter F, used as a dust-collecting filter, receives air current in a direction shown with arrows A in FIG. 2. The air filter F is a sheet 2 of textile of synthetic fiber thread 1 three-dimensionally knitted and processed with electrification, namely, made an electret.

The synthetic fiber thread 1 is composed of polypropylene. And, the synthetic fiber thread 1 is composed of a monofilament, notched as to become fluffy when it is bent, or marked with many scratches. When the synthetic fiber thread 1 is three-dimensionally knitted by a knitting machine, (although lubricant oil is conventionally added to a guide hole and the point of a needle,) omitting the lubricant oil, the notches or many scratches are formed on the surface of the synthetic fiber thread 1 by non-lubrication knitting (method). The notches or many scratches increase the surface area of the synthetic fiber thread 1 to facilitate the electrification. And, dust-collecting effect is improved thereby. Although the cross-sectional portion (hatched portion) is simplified in FIG. 2, this is made of the knitted synthetic fiber thread 1 (also in FIGS. 4, 5, 6, 7, 8, and 10).

Figure 4:
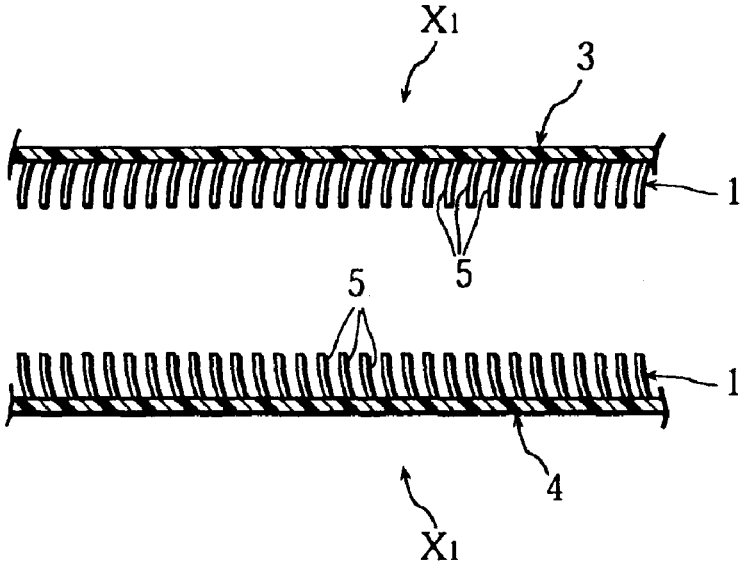
FIG. 4 is a cross-sectional side view showing a semi-fabricated air filter in a second embodiment.
Figure 5:
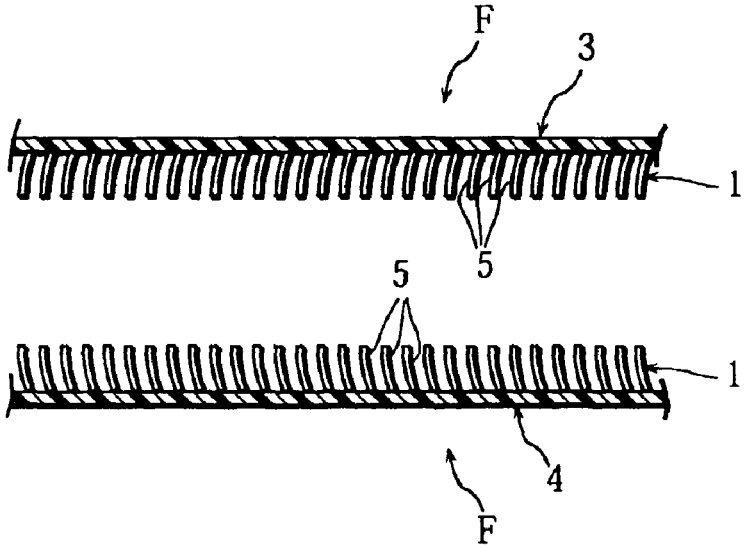
FIG. 5 is a cross-sectional side view showing an air filter.

FIG. 4 and FIG. 5 show a second embodiment. The thick sheet 2 of textile of synthetic fiber thread 1 three-dimensionally knitted (refer to FIG. 1 and FIG. 2) is sliced at a middle position in a thickness direction and separated into a front face 3 side and a rear face 4 side. One of the front face 3 and the rear face 4 is one side, and many short fibers 5 are protruding from another side. Further, the filter is electrified as a whole.

Figure 6:
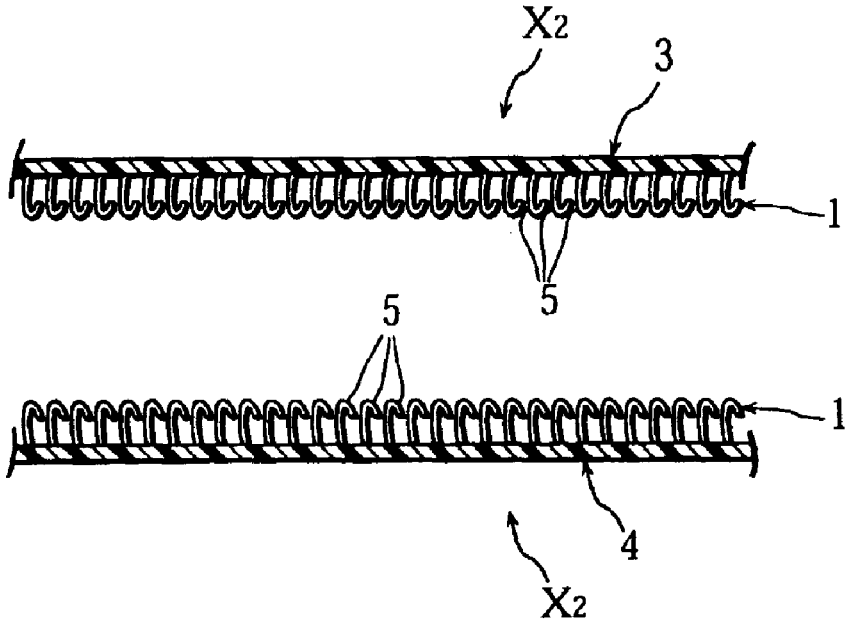
FIG. 6 is a cross-sectional side view showing a semi-fabricated air filter in a third embodiment.
Figure 7:
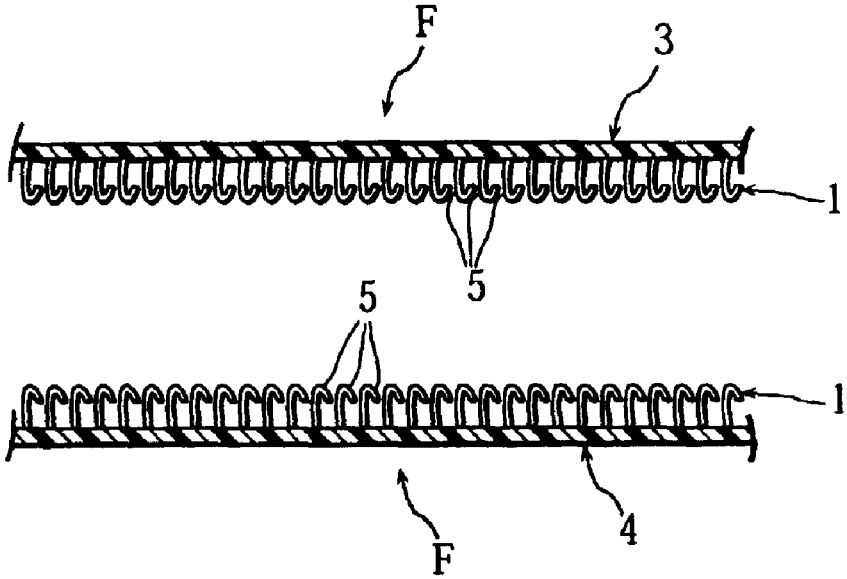
FIG. 7 is a cross-sectional side view showing an air filter.

FIG. 6 and FIG. 7 show a third embodiment. The thick sheet 2 of textile of synthetic fiber thread 1 three-dimensionally knitted (refer to FIG. 1 and FIG. 2) is sliced at a middle position in a thickness direction and separated into a front face 3 side and a rear face 4 side. One of the front face 3 and the rear face 4 is one side, and many short fibers 5 are protruding from another side. Further, the filter is electrified as a whole, and the protruding short fiber 5 is curled. This curling, J-shaped in FIGS. 6 and 7, may be freely set as helical, volute, spiral, or ring.

Figure 8:
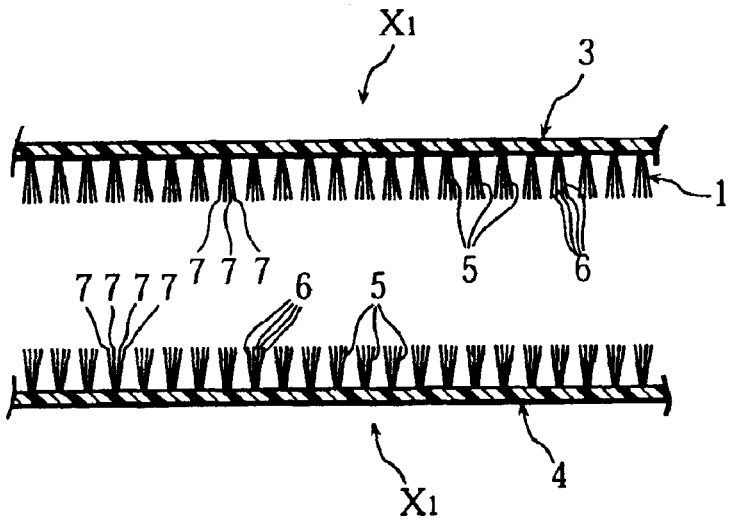
FIG. 8 is a cross-sectional side view showing a semi-fabricated air filter in a fourth embodiment.
Figure 9:
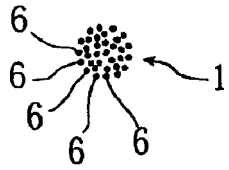
FIG. 9 is an enlarged cross-sectional view showing a multifilament.

FIG. 8 and FIG. 9 show a fourth embodiment. The thick sheet 2 of textile with synthetic fiber thread 1 of multifilaments three-dimensionally knitted is sliced at a middle position in a thickness direction and separated into a front face 3 side and a rear face 4 side. One of the front face 3 and the rear face 4 is one side, and many short fibers 5, each of which is composed of multifilament, are protruding from another side. Further, the filter is electrified as a whole. That is to say, as shown in the cross-sectional view of FIG. 9, one unit of the short fiber 5 is composed of several or several decades of extra-fine multifilaments 6 bundled.

Figure 10:
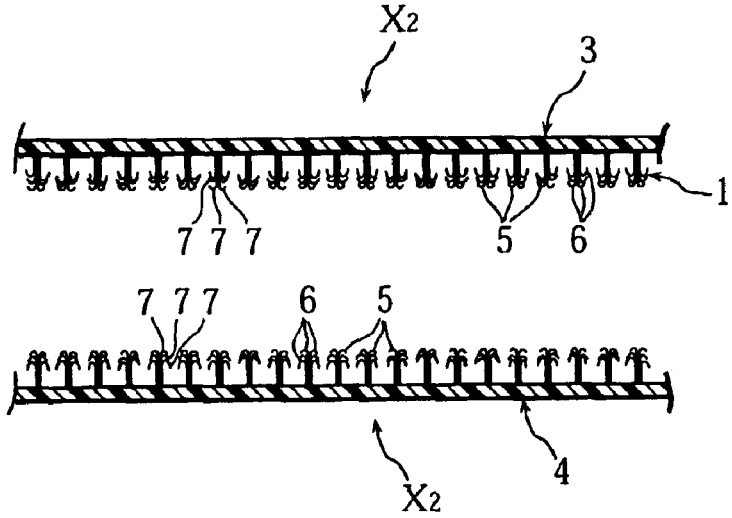
FIG. 10 is a cross-sectional side view showing a semi-fabricated air filter in a fifth embodiment.
Figure 11:
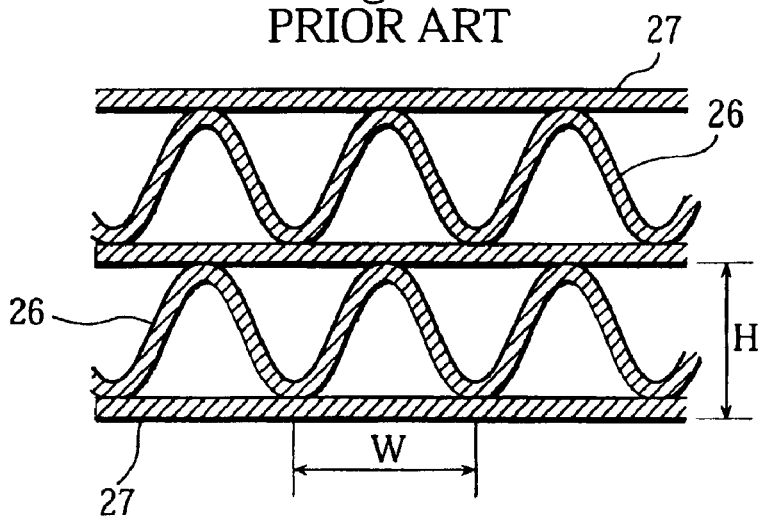
Fig. 11 PRIOR ART
FIG. 11 is an enlarged cross-sectional front view showing dimensions and configuration of a comparison example.
Figure 12:
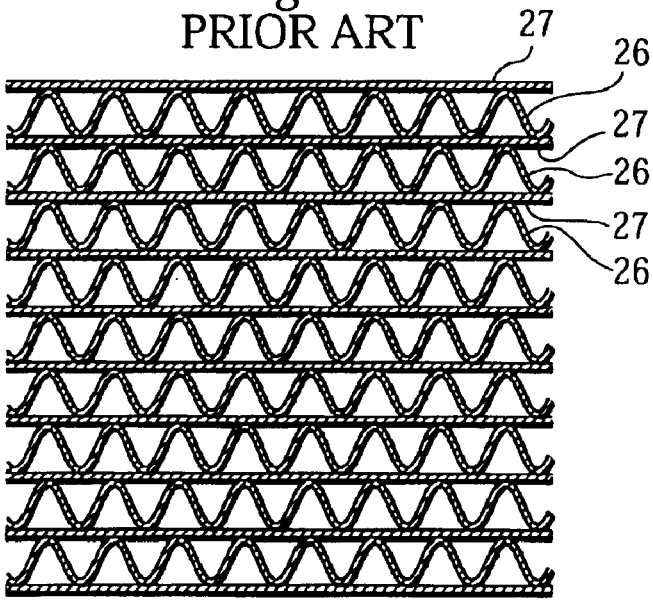
Fig. 12 PRIOR ART
FIG. 12 is a cross-sectional front view showing a conventional example.
Figure 13:
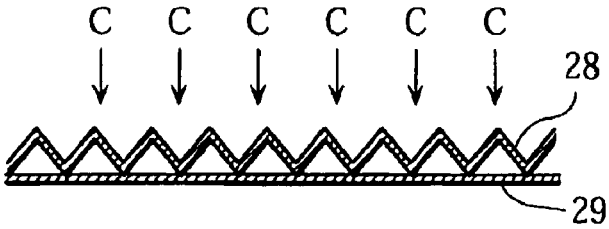
Fig. 13 PRIOR ART
FIG. 13 is a cross-sectional front view showing another conventional example.

FIG. 10 shows a fifth embodiment. The thick sheet 2 of textile with synthetic fiber thread 1 of multifilament three-dimensionally knitted (refer to FIG. 1 and FIG. 2) is sliced at a middle position in a thickness direction and separated into a front face 3 side and a rear face 4 side. One of the front face 3 and the rear face 4 is one side, and many short fibers 5, each of which is composed of multifilament, are protruding from another side. Further, the filter is electrified as a whole. Each filament 6 of the short fiber 5, composed of protruding multifilaments, is curled. Preferably, curled end portions 7 are freely dispersed and separated in many directions to increase the dust-collecting effect.

Next, a manufacturing method of the air filter F in the first embodiment is described (refer to FIG. 1 and FIG. 2). The synthetic fiber thread 1 is three-dimensionally knitted to make the thick sheet 2 of textile, then, the thick sheet 2 of textile is electrified.

A manufacturing method of the air filter F in the second embodiment is described. First, the synthetic fiber thread 1 is three-dimensionally knitted to make the thick sheet 2 of textile. Next, the thick sheet 2 of textile is sliced at a middle position in thickness direction and separated to make two semi-fabricated air filters $X_1$ in which many short fibers 5 are protruding from the front face 3 and the rear face 4. Then, the semi-fabricated air filters $X_1$ are electrified to make the air filter F.

A manufacturing method of the air filter F in the third embodiment is described (refer to FIG. 6 and FIG. 7). First, the synthetic fiber thread 1 is three-dimensionally knitted to make the thick sheet 2 of textile. Next, the thick sheet 2 of textile is sliced at a middle position in thickness direction and separated to make two semi-fabricated air filters $X_2$ in which many short fibers 5 protruding from the front face 3 and the rear face 4 are curled by heating. Then, the semi-fabricated air filters $X_2$ are electrified to make the air filter F.

A manufacturing method of the air filter F in the fourth embodiment is described (refer to FIG. 8). First, the synthetic fiber thread 1 of multifilament (refer to FIG. 9) is three-dimensionally knitted to make the thick sheet 2 of textile. Next, the thick sheet 2 of textile is sliced at a middle position in thickness direction and separated to make two semi-fabricated air filters $X_1$ in which many short fibers 5 are protruding from the front face 3 and the rear face 4. By the cutting and separation, the end portions 7 on the cut side are freely dispersed and separated. Then, the semi-fabricated air filters $X_1$ are electrified.

A manufacturing method of the air filter F in the fifth embodiment is described (refer to FIG. 10). First, the synthetic fiber thread 1 of multifilament is three-dimensionally knitted to make the thick sheet 2 of textile. Next, the thick sheet 2 of textile is sliced at a middle position in thickness direction and separated. By the cutting and separation, the end portions 7 on the cut side are freely dispersed and separated.

The short fibers 5 protruding from the front face 3 and the rear face 4 are curled by heating to make two semi-fabricated air filters $X_2$, then, the semi-fabricated air filters $X_2$ are electrified.

The present invention may be modified in design. For example, the notches and scratches may be omitted. And, both of the monofilament and the multifilament may be used as the synthetic fiber thread 1 to make a thick sheet 2 of mixed textile to be electrified, or sliced and separated further. For example, the filter may have a construction in which the features of FIG. 5 and FIG. 8 are mixed (combined), or the features of FIG. 7 and FIG. 10 are mixed (combined).

EXAMPLES

Two rectangular air filters relating to the present invention (described with FIG. 1 through FIG. 3), of which dimensions in front view is 289 mm×222 mm are made as an example 1 and as an example 2. Collection efficiency of dust of the air filters F is shown in Table 1. In Table 1, each of 0.3 μm, 0.5 μm, and 1.0 μm means the size of the dust (average diameter of the particle).

TABLE 1

| | PRESSURE LOSS | COLLECTION EFFICIENCY % | | |
|---|---|---|---|---|
| | Pa | 0.3 μm | 0.5 μm | 1.0 μm |
| EXAMPLE 1 | 3 | 12.25 | 19.80 | 32.81 |
| EXAMPLE 2 | 3 | 9.86 | 21.00 | 34.31 |

And, two rectangular air filters having a corrugated honeycomb construction as comparison examples 1 and 2, of which dimensions in front view is 300 mm×350 mm, width dimension W between two concave portions of the first member 26 of round wave is 3.6 mm and height H between neighboring flat second members 27 is 2 mm. Collection efficiency of dust of the air filters F is shown in Table 2. In Table 2, each of 0.3 μm, 0.5 μm, and 1.0 μm means the size of the dust (average diameter of the particle).

TABLE 2

| | PRESSURE LOSS | COLLECTION EFFICIENCY % | | |
|---|---|---|---|---|
| | Pa | 0.3 μm | 0.5 μm | 1.0 μm |
| COMPARISON EXAMPLE 1 | 8 | 8.39 | 14.52 | 26.68 |
| COMPARISON EXAMPLE 2 | 8 | 9.27 | 10.76 | 12.54 |

Table 1 and Table 2 show that the air filter F relating to the present invention has good collection efficiency of dust.

According to the air filter of the present invention, an air filter is easily made without corrugation and pleating work.

And, collection efficiency of dust is good. The collection efficiency of dust is further improved by many protruding short fibers 5.

And, the dust can be collected efficiently further. And, the large surface area of the synthetic fiber thread 1 improves the collection efficiency of dust.

Further, many filaments 6 enlarge the surface area of the synthetic fiber thread 1 to collect the dust efficiently further.

According to the manufacturing method for air filter of the present invention, an air filter is easily made without corrugation and pleating work.

And, the air filter F having good collection efficiency of dust can be easily made.

And, the air filter F having further good collection efficiency of dust can be easily made.

Further, the air filter F having large surface area of the synthetic fiber thread 1 and further good collection efficiency of dust can be easily made.

While preferred embodiments of the present invention have been described in this specification, it is to be understood that the invention is illustrative and not restrictive, because various changes are possible within the spirit and indispensable features.

What is claimed is:

1. An air filter comprising a construction in which a thick sheet of textile made of synthetic fiber thread of multifilament knitted three-dimensionally is sliced at a middle position in a thickness direction and separated into a front face side and a rear face side, one of the front face and the rear face is one side, many short fibers of multifilament are protruding from another side, and the filter is electrified as a whole.

* * * * *